US005123361A

United States Patent [19]

Nieh et al.

[11] Patent Number: 5,123,361

[45] Date of Patent: Jun. 23, 1992

[54] ANNULAR VORTEX COMBUSTOR

[75] Inventors: Sen Nieh, Burtonsville, Md.; Tim T. Fu, Camarillo, Calif.

[73] Assignee: The United States of America as represented by the Secretary of the Navy, Washington, D.C.

[21] Appl. No.: 805,722

[22] Filed: Nov. 25, 1991

[51] Int. Cl.[5] ..... F23D 1/02

[52] U.S. Cl. ..... 110/264; 110/234; 431/173

[58] Field of Search ..... 431/173; 110/264, 234, 110/213

[56] References Cited

U.S. PATENT DOCUMENTS

| | | | |
|---|---|---|---|
| 1,180,792 | 4/1916 | Norrman | 110/264 |
| 2,707,444 | 5/1935 | Van Loon | 110/264 |
| 3,855,951 | 12/1974 | Giles | 110/234 |
| 4,144,019 | 3/1979 | Lyshkow et al. | 431/173 |

*Primary Examiner*—Carroll B. Dority
*Attorney, Agent, or Firm*—Ron G. Billi; Melvin Sliwka

[57] ABSTRACT

An apparatus for burning coal water fuel, dry ultrafine coal, pulverized coal and other liquid and gaseous fuels including a vertically extending outer wall and an inner, vertically extending cylinder located concentrically within the outer wall, the annnular space between the outer wall and the inner cylinder defining a combustion chamber and the all space within the inner cylinder defining an exhaust chamber. Fuel and atomizing air are injected tangentially near the bottom of the combustion chamber and secondary air is introduced at selected points along the length of the combustion chamber. Combustion occurs along the spiral flow path in the combustion chamber and the combined effects of centrifugal, gravitational and aerodynamic forces cause particles of masses or sizes greater than the threshold to be trapped in a stratified manner until completely burned out. Remaining ash particles are then small enough to be entrained by the flue gas and exit the system via the exhaust chamber in the opposite direction.

27 Claims, 4 Drawing Sheets

| PARAMETER | |
|---|---|
| FIRING RATE, MB/H | 2.0 |
| CONFIGURATION, IN | |
| D | 19 |
| d | 8 |
| H | 33 |
| h | 27 |
| OPERATION (@DESIGN CAPACITY) | |
| AVERAGE FIRING INTENSITY, MB/Hft$^3$ | 0.3 |
| AIR INJECTION VELOCITY, ft/s | 120 |
| FUEL INJECTION VELOCITY, ft/s | 60 |
| AVERAGE GAS VELOCITY, ft/s | 5.9 |
| EXIT GAS VELOCITY, ft/s | 27.2 |

PROPERTIES OF PARENT COAL
I.D. No. UE3-191-PCO-E BED: WEST VIRGINIA UPPER ELKHORN No. 3

| PROXIMATE ANALYSIS (% WT.): | | |
|---|---|---|
| MOISTURE | 0.72 | % |
| VOLATILE MATTER | 34.80 | % |
| FIXED CARBON | 63.00 | % |
| ASH | 1.48 | % |
| HEATING VALUE | 14,756 | BTU/lb |

| ULTIMATE ANALYSIS (%WT.): | | |
|---|---|---|
| CARBON | 86.83 | % |
| HYDROGEN | 5.14 | % |
| OXYGEN | 3.64 | % |
| NITROGEN | 1.54 | % |
| SULFUR | 0.63 | % |
| ASH/MOISTURE | 2.22 | % |

| DUC SIZE DISTRIBUTION | |
|---|---|
| MEAN PARTICLE DIA. (μm) | 11.5 |
| %<100 MESH (149 μm) | 100 |
| %<400 MESH (38 um) | 98 |

| PC SIZE DISTRIBUTION | |
|---|---|
| MEAN PARTICLE DIA. (μm) | 40 |
| %<100 MESH (149 μm) | 99.7 |
| %<200 MESH (75 μm) | 86.9 |

| CWF PROPERTIES | |
|---|---|
| SOLID LOADING, % WT. | 65-67 |
| VISCOSITY, cp@100/s | <1,000/110 |
| SPECIFIC GRAVITY @ 60°F | 1.2 |
| HEATING VALUE, BTU/lb | 9,930 |

| CWF SIZE DISTRIBUTION | |
|---|---|
| MEAN PARENT COAL SIZE | 30 μm |
| TOP COAL SIZE | 99%<149 μm |
| SMD OF DROPLETS | 106 μm |
| AVERAGE DROPLET SIZE | 75 μm |

*Fig. 6.*

ANNULAR VORTEX COMBUSTOR

BACKGROUND OF THE INVENTION

This invention relates to an apparatus for burning dry ultrafine coal (DUC), pulverized coal (PC), coal water fuel (CWF) and other liquid or gaseous fuels especially in applications for space and/or water heating.

In the past, cyclone type combustors have been widely used for large utility power plants. These devices generally consist of horizontal cylindrical combustion chambers wherein fuel and air are injected axially at the center or tangentially at the side of one end. Burning continues along the length of the combustor until exiting the opposite end.

Cyclone combustors are inherently high temperature devices which promote the formation of undesirable $NO_x$ and preclude the use of desirable limestone injection to remove $SO_x$. In addition, these devices suffer from: relatively short particle residence time due to the straight through design; rapid decay of gas-gas and gas-particle mixing and reactions both along the combustor axis and towards the core region; and entrainment of fuel particles in the center exhaust region where combustion is severely limited due to low, local oxygen levels and poor mixing causing particles to quickly leave the combustor with the flue gas stream. As a result. extensive flue gas treatments are necessary to clean up the exhaust to an environmentally acceptable level.

Attempts have been made to improve the efficiency of cyclone type combustors by providing a horizontal double vortex configuration wherein fuel particles are entrained in a spiral flow path for maximum combustion and minimum particulate emission. Such a device is shown in U.S. Pat. No. 4,144,019.

Although providing an increased spiral flow path thereby increasing the residence time of a particle, these devices can neither retain a particle for sufficient lengths of time for complete burnout nor provide a controlled burning environment within the combustion chamber. As a result, these type cyclone combustors provide less-than-desirable performance in terms of combustion efficiency, firing intensity, operational flexibility, and pollution control.

SUMMARY OF THE INVENTION

Accordingly, the annular vortex combustor of the present invention provides an apparatus for burning DUC, PC, CWF and other fuels in an efficient, non polluting manner. The novel apparatus of the present invention includes an outer, vertically extending, annular, combustion chamber and an inner, vertically extending exhaust chamber. Fuel and atomizing air are tangentially injected near the bottom of the combustion chamber and secondary air is injected, at selected points, along the length of the combustion chamber. Secondary air contributes to controlling the progress of combustion; deflects incoming fuel away from the combustion chamber outer wall; maintains a strong swirling flow inside the combustion chamber; and forms a reducing environment during the early stages of combustion to minimize $NO_x$ formation. Combustion occurs along the spiral flow path in the combustion chamber. The combined effects of centrifugal, gravitational and aerodynamic forces cause particles of masses or sizes greater than the threshold to be trapped in a stratified manner in the combustion chamber - heavy particles near the bottom, light particles near the top. As fuel particles are burned, they continually reduce in mass and physical size until completely burned out. Remaining ash particles are then small enough to be entrained by the flue gas and exit the system via the inner exhaust chamber in the opposite direction. Combustion is controlled throughout. Heat is removed from selected areas of the combustion chamber by water cooled surfaces to reduce the temperature and promote low $NO_x$ formation (ie. emissions). The amount of heat removed is also controlled in other selected areas by insulating, refractory material to promote drying, devolatilization and ignition in the area of fuel injection and also to promote continued burning of fuel particles near the top of the combustion chamber. A flange at the top of the exhaust chamber prevents short circuiting of fuel particles ascending the combustion chamber. The novel apparatus of the present invention achieves low $NO_x$ emissions, high combustion efficiency and firing intensity in an operationally, flexible device especially suitable for space and/or water heating as well as other applications.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 6 lists parameters of the preferred CWF fuel and other suitable fuels.

DETAILED DESCRIPTION OF THE PREFERRED EMBODIMENT

Figure 1:
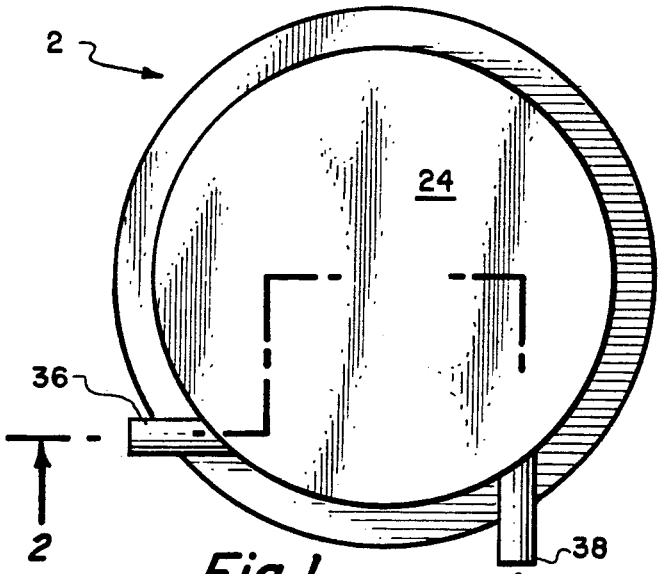
FIG. 1 is a top plan view of the annular vortex combustor of the present invention.
Figure 2:
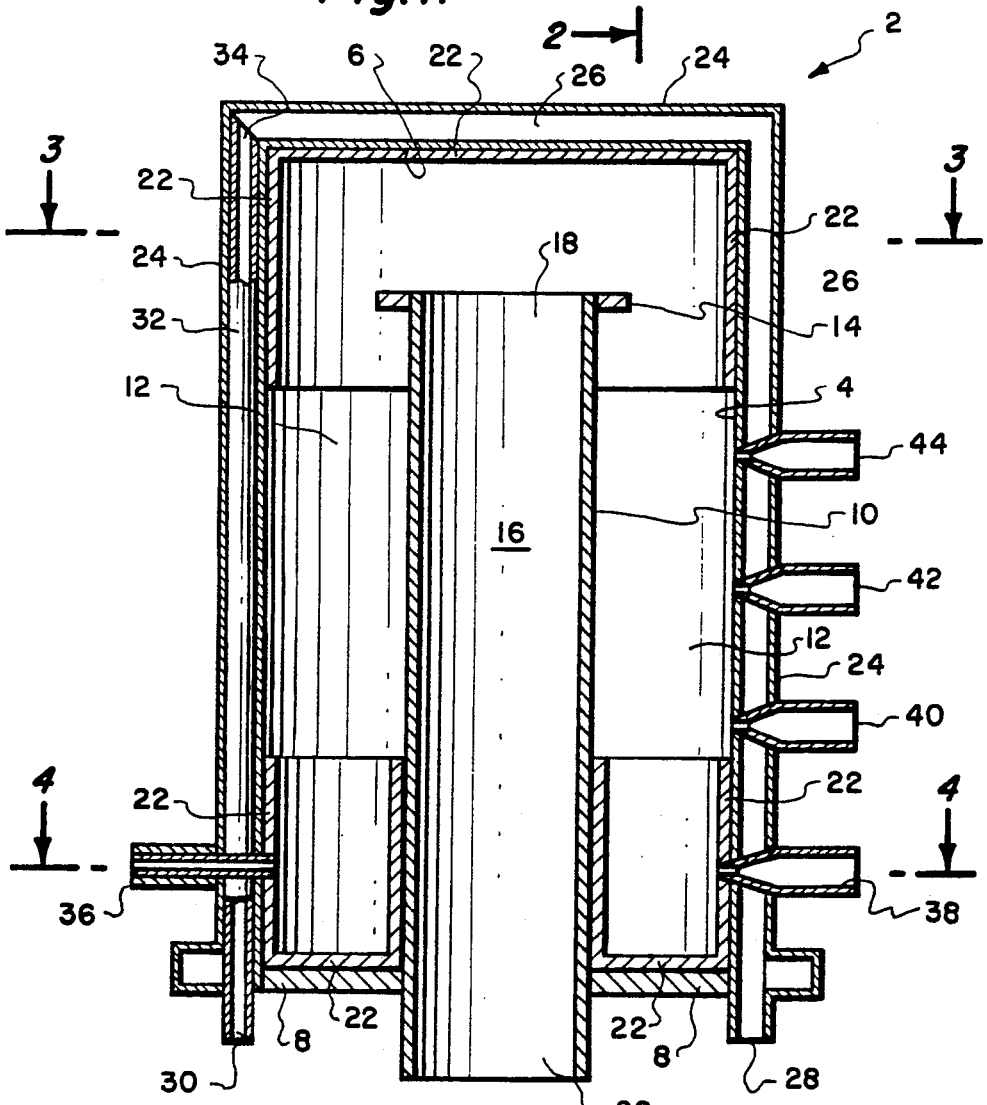
FIG. 2 is a cross sectional elevation view taken through line 2—2 of FIG. 1.

The preferred embodiment of the present invention is best illustrated by way of example in FIGS. 1 to 4. As shown in FIG. 2, annular vortex combustor 2 includes vertical, cylindrical wall 4 which terminates on one end in top 6 and terminates on the other end in bottom 8. Both top 6 and bottom 8 are horizontal. Cylinder 10 is located concentrically within wall 4, the annulus between wall 4 and cylinder 10 defining combustion chamber 12. The bottom end of cylinder 10 defines inner (exhaust) chamber 16, with openings 18 and 20 in the top and bottom of cylinder 10, respectively. The preferred height of flange 14 above bottom 8 is .85 times the height of wall 4. High temperature, castable, refractory material 22 lines the inside of top 6, the inside of bottom 8, the top ¼ and bottom ¼ of wall 4 and the outside portion of cylinder 10 above bottom 8, all as shown in FIG. 2.

Outer wall 24 is spaced from wall 4 and top 6, the space therebetween defining water jacket 26. Cooling water enters water jacket 26 at inlet 28 and exits through outlet 30 of outlet pipe 32. To minimize short circuiting of cooling water, outlet pipe 32 extends up to the top portion of water jacket 26 and terminates in mitered end 34. It can thus be seen that cooling water enters at inlet 28, flows up and around water jacket 26, enters outlet pipe 32 at mitered end 34 and exits outlet pipe 32 at outlet 30.

Air is supplied to combustion chamber 12 at various points. 1–2% of the total air supplied is called "primary air". Primary air is first mixed with CWF to form a CWF/air mixture (which promotes atomization). The mixture is then injected into combustion chamber 12 via nozzle 36. 98–99% of the total air supplied is called "secondary air". Secondary air is injected into combustion chamber 12 via nozzles 38, 40, 42, and 44. "Excess air" is the amount of air supplied to combustion chamber 12 in excess of the stoichiometric equivalent. 20% excess air is preferred and is supplied to combustion chamber 12 through secondary air nozzles 38, 40, 42, and 44. In the preferred embodiment, high pressure primary air is injected through nozzle 36 at approximately 70 psi at a flow rate of 0.15#/#CWF. CWF is injected at approximately 100 psi. The orifice diameter of nozzle 36 is approximately 0.18". Low pressure (close to ambient pressure) secondary air is injected at approximately 375 CFM at 20% excess air. Secondary air nozzles have rectangular orifices approximately 1.97" long and 0.98" wide.

Figure 4:
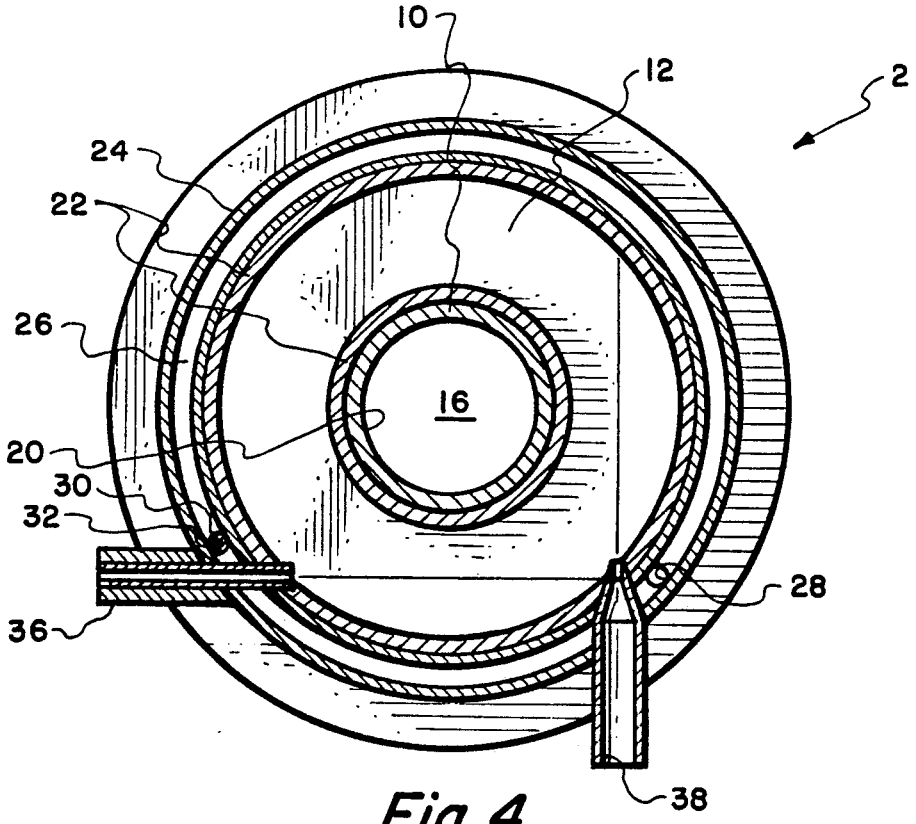
FIG. 4 is a cross sectional view taken through section 4-4 of FIG. 2.

CWF droplets should be dispersed, dried and ignited in the narrow annular space of combustion chamber 12 before wall impingement and a resultant deposit buildup and flow blockage occurs. Impingement occurs most often in the first ¼ rotation after CWF introduction into combustion chamber 12 while the fuel particles are still wet. Once dried and ignited, a fuel particle is much less likely to deposit or "stick" and buildup on wall 4 or cylinder 10. If the spray dispersion angle of injected CWF is too large, the spray will impinge on cylinder 10 and wall 4. If the spray angle is too small, the spray will achieve or approach a solid stream and be too strong for timely dispersion prior to impingement on wall 4. Accordingly, the preferred spray dispersion angle from nozzle 36 is 30 degrees. The preferred vertical orientation of the axis of nozzle 36 is parallel to bottom 8, as shown in FIG. 2, and is located approximately four inches above bottom 8. As shown in FIG 4, the preferred horizontal orientation of the axis of nozzle 36 is tangent to a circle equidistant from cylinder 10 and wall 4. In this way, dispersion, drying and ignition of CWF particles is favored over wall impingement.

Wall impingement may be further reduced by introducing a strong jet of deflecting air at the proper location to deflect or bend the CWF spray towards the main gas stream. As shown in FIG. 4, secondary air nozzle 38 is positioned to deflect incoming CWF particles away from wall 4. The axis of nozzle 38 is both perpendicular to the axis of CWF nozzle 36 and tangent to a circle equidistant from cylinder 10 and wall 4. The axis of nozzle 38 is also parallel to bottom 8 and located four inches above bottom 8.

Figure 3:
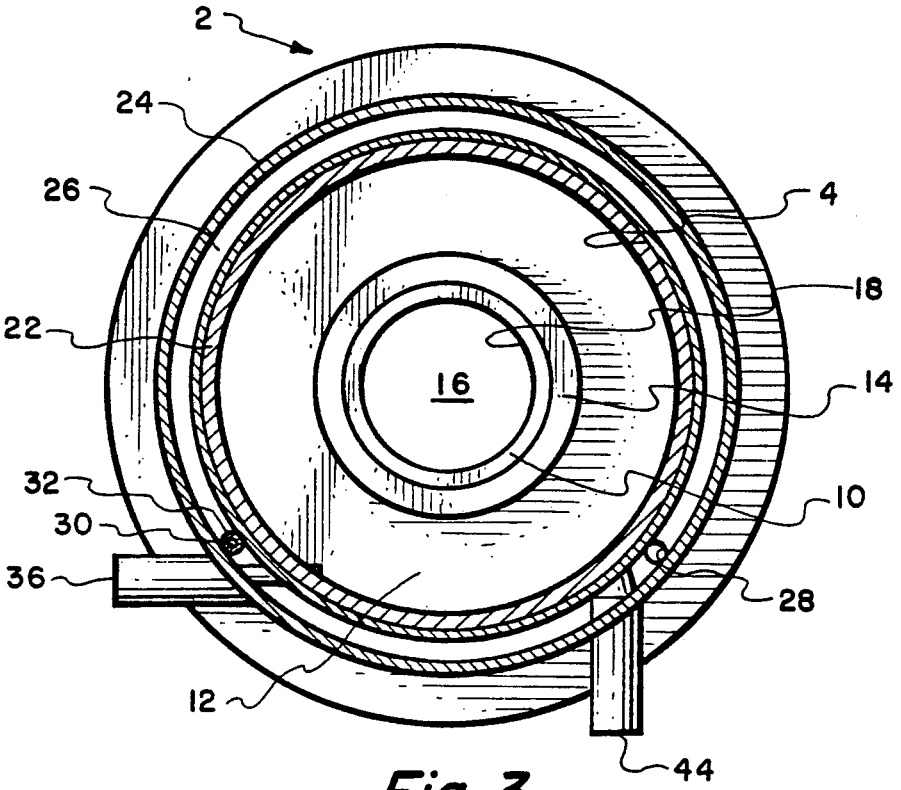
FIG. 3 is a cross sectional view taken through section 3-3 of FIG. 2.

Secondary air nozzles 40, 42 and 44 are horizontally orientated as nozzle 38 and are vertically distributed above nozzle 38 with the axis of adjacent nozzles five inches apart, as shown in FIGS. 2, 3 and 4. It should be noted that nozzle 38 is primarily responsible for providing air to deflect injected CWF particles. Nozzles 38 and 40 each provide 40% of the secondary air and nozzles 42 and 44 each provide 10% of the secondary air.

Secondary air contributes to controlling the progress of combustion and hence the heat release to achieve substantially complete burnout before the products of combustion enter the exhaust chamber. In addition, secondary air substantially contributes to generating, maintaining and controlling a strong swirling flow in combustion chamber !2 whereby the combined effects of centrifugal, gravitational and aerodynamic forces cause particles to be trapped in combustion chamber 12. Accordingly, particles are "automatically" retained in combustion chamber 12 until small and/or light enough to be entrained by the flue gas and swept out through exhaust chamber 16.

Another important factor in minimizing deposition/accumulation is to maintain a sufficiently high temperature in the combustion chamber in the area of CWF injection. This area is designated as the "ignition zone". High temperatures in the ignition zone promote rapid drying and devolatilization of the just injected CWF particles and hastens ignition. As a result, particles tend to be dried out and ignited before wall impingement occurs thereby lessening the tendency for deposition and accumulation. High temperatures are promoted in the ignition zone by the use of refractory material 22 in the bottom of combustion chamber 12 thus substantially negating the effect of water jacket 26 in that area. In the preferred embodiment, refractory material 22 is ½" thick.

It can now be appreciated that unburned fuel in the form of CWF, together with primary air to promote atomization, is tangentially injected into combustion chamber 12 near the bottom. Secondary air is tangentially injected into combustion chamber 12 to form a strong swirling, recirculating and developing turbulent flow field. Fuel particles (or droplets) are dried, devolatilized, ignited and burned out while spirally and/or circularly ascending combustion chamber 12. Burned out particles are finally entrained by the flue gas and exit the system via inner exhaust chamber 16. Without control, temperatures tend to be lower in the bottom of the combustor where CWF is injected due to evaporation and ignition start-up. Without control, temperatures tend to be lower in the top of the combustor due to heat being swept out with the flue gas. Without control, temperatures tend to be higher in the middle (combustion) zone due to the heat released from combustion. To maximize performance, controls are employed to maintain temperature zones within combustion chamber 12. Temperatures are lowered in combustion chamber 12 in the proximity of water jacket 26 (combustion zone) wherein heat is transferred into water jacket 26 and to the water flowing therein. Temperatures are raised in the top and bottom of combustion chamber 12 due to insulating refractory material reducing heat transfer to water jacket 26. Maintaining higher temperatures in the bottom of chamber 12 promotes rapid drying, devolatilization and ignition of injected fuel. Maintaining higher temperatures in the top of chamber 12 improves combustion efficiency and provides high firing intensities. In the preferred embodiment, temperatures are maintained at approximately 1700° F. in the top of combustion chamber 12 and approximately 2100° F. in the bottom (ignition zone) and in the middle (combustion) zone. It should be noted that approximately 40–50% of the total heat generated is removed by water jacket 26. Flange 14 prevents particles from rising along cylinder 10 and prematurely exiting combustion chamber 12.

Figures 5A, 5B:
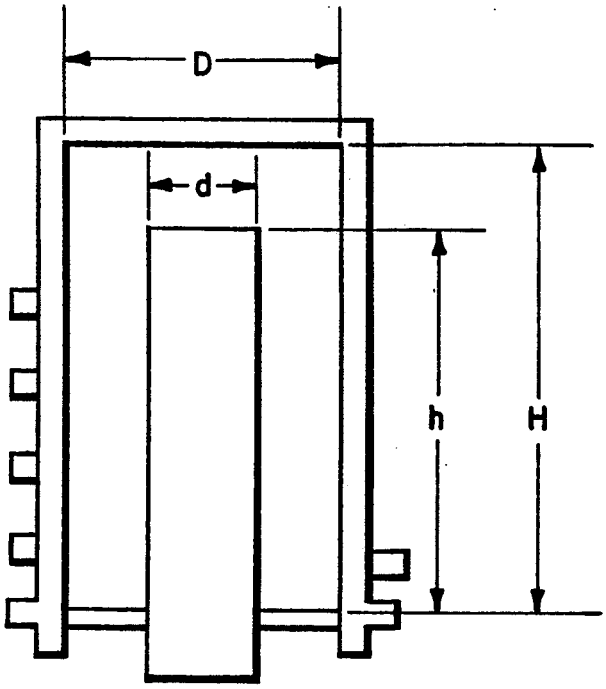
FIG. 5*a* lists parameters of the preferred embodiment of the present invention.
FIG. 5*b* is a cross sectional view of the present invention showing the location of the dimensional parameters listed in FIG. 5*a*.

FIG. 5*a* lists important parameters for the preferred embodiment wherein corresponding lettered designations are found in FIG. 5*b*.

FIG. 6 provides a summary of the properties of the preferred CWF fuel as well as DUC and PC fuel properties that are suitable. CWF size distribution properties are also shown.

Obviously many modifications and variations of the present invention are possible in light of the above teaching. It is therefore to be understood that within the scope of the appended claims, the invention may be practiced otherwise than as specifically described.

What is claimed is:

1. A combustor comprising:

a) an outer, vertically extending annular combustion chamber with a top and a bottom;

b) an inner, vertically extending exhaust chamber located concentric to the combustion chamber, the exhaust chamber having an inlet and an outlet, the inlet extending to the top portion of said combustion chamber and having a flange;

c) fuel inlet means for injecting fuel into said combustion chamber;

d) air inlet means for injecting secondary air into said combustion chamber.

2. The apparatus defined in claim 1, wherein said exhaust chamber extends beyond the bottom of said combustion chamber.

3. The apparatus defined in claim 2, further including means for retaining heat in said combustion chamber.

4. The apparatus defined in claim 3, further including a water jacket around the top and sides of said combustion chamber for removing heat in said combustion chamber.

5. The apparatus defined in claim 4, wherein the fuel inlet means is located in the lower portion of said combustion chamber.

6. The apparatus defined in claim 5, wherein the secondary air inlet means includes one or more nozzles.

7. The apparatus defined in claim 6, wherein the lowermost secondary air nozzle is the same height above said bottom of said combustion chamber as is said fuel inlet means.

8. The apparatus defined in claim 7, wherein said fuel inlet means and said air inlet means are injected tangentially into said combustion chamber.

9. The apparatus defined in claim 8, wherein the axis of said fuel inlet means and the axis of said air inlet means are parallel to the bottom of said combustion chamber.

10. The apparatus defined in claim 9 wherein said fuel inlet means has a spray dispersion angle of 30° and the axis of said fuel inlet means is tangent to a circle midway between the inner and outer walls of said combustion chamber.

11. The apparatus defined in claim 10, wherein said nozzles of said air inlet means are located vertically, one above the other.

12. The apparatus defined in claim 11, wherein the axis of the lowermost air inlet nozzle is both perpendicular to the axis of said fuel inlet nozzle and tangent to a circle midway between the inner and outer walls of said combustion chamber.

13. A combustor comprising:

a) an outer vertically extending wall with a top and bottom;

b) an inner vertically extending cylinder located concentrically within the outer wall, the annular space between said outer wall and the inner cylinder defining a combustion chamber, the top of said inner cylinder having a flange and an inlet communicating with the combustion chamber, and the bottom of said inner cylinder including an outlet, the space within said inner cylinder defining an exhaust chamber;

c) means for injecting fuel into said combustion chamber;

d) means for injecting secondary air into said combustion chamber.

14. The apparatus defined in claim 13, wherein said inner cylinder extends beyond the bottom of said outer wall.

15. The apparatus defined in claim 14, further include means for controlling the temperature within said combustion chamber.

16. The apparatus defined in claim 15, wherein the temperature control means includes refractory material located in the combustion chamber.

17. The apparatus defined in claim 15, wherein the temperature control means includes a water jacket located around said outer wall and said top for removing heat from said combustion chamber.

18. The apparatus defined in claim 15, wherein the temperature control means includes refractory material located in the combustion chamber and further including a water jacket located around said outer wall and said top.

19. The apparatus defined in claim 18, wherein the refractory material is located at the upper and lower portions of said combustion chamber.

20. The apparatus defined in claim 19, wherein the fuel injection means is located near the bottom of said combustion chamber.

21. The apparatus defined in claim 20, wherein the secondary air injection means includes one or more nozzles.

22. The apparatus defined in claim 21, wherein the lowermost secondary air nozzle is the same height above said bottom of said combustion chamber as is said fuel injection means.

23. The apparatus defined in claim 22, wherein said fuel injection means and said air injection means are injected tangentially into said combustion chamber.

24. The apparatus defined in claim 23, wherein the axis of said fuel injection means and the axis of said air injection means are parallel to the bottom of said cylindrical wall.

25. The apparatus defined in claim 24, wherein said fuel inlet means has a spray dispersion angle of 30° and the axis of said fuel inlet means is tangent to a circle midway between the inner and outer walls of said combustion chamber.

26. The apparatus defined in claim 25, wherein said nozzles of said air inlet means are located vertically, one above the other.

27. The apparatus defined in claim 26, wherein the axis of the lowermost air inlet nozzle is both perpendicular to the axis of said fuel inlet nozzle and tangent to a circle midway between the inner and outer walls of said combustion chamber.

* * * * *